US009117437B2

(12) United States Patent
Chin et al.

(10) Patent No.: US 9,117,437 B2
(45) Date of Patent: Aug. 25, 2015

(54) NOISE CANCELLING HEADPHONE

(75) Inventors: Kah Chun Chin, Penang (MY); Choon Huat Khoh, Penang (MY); Siew Pheng Chong, Penang (MY); Jin Ngee Ong, Penang (MY)

(73) Assignee: Sony EMCS (Malaysia) Sdn. Bhd., Kuala Lumpur (MY)

( * ) Notice: Subject to any disclaimer, the term of this patent is extended or adjusted under 35 U.S.C. 154(b) by 1046 days.

(21) Appl. No.: 12/631,464

(22) Filed: Dec. 4, 2009

(65) Prior Publication Data

US 2010/0142718 A1 Jun. 10, 2010

(30) Foreign Application Priority Data

Dec. 4, 2008 (MY) ..... 20084930

(51) Int. Cl.
*H04R 27/00* (2006.01)
*G10K 11/178* (2006.01)
*H04R 1/10* (2006.01)

(52) U.S. Cl.
CPC ..... *G10K 11/178* (2013.01); *H04R 1/1083* (2013.01); *G10K 2210/1081* (2013.01)

(58) Field of Classification Search
CPC .... H04R 1/1083; H04R 5/033; G10K 11/178; G10K 2210/1081; G10K 2210/108; G10K 11/1788
USPC ..... 381/71.6, 71.2, 71.8, 71.1, 71.13, 381/71.14, 122, 95, 94.7, 94.1, 370, 120, 381/74, 57, 71.3, 71.4, 71.5, 71.7, 71.9, 381/71.11, 71.12, 97
See application file for complete search history.

(56) References Cited

U.S. PATENT DOCUMENTS

| | | | | |
|---|---|---|---|---|
| 3,306,991 | A * | 2/1967 | Wood | 381/72 |
| H0000417 | H * | 1/1988 | Miles | 381/71.6 |
| 5,465,240 | A * | 11/1995 | Mankovitz | 369/1 |
| 5,825,897 | A | 10/1998 | Andrea et al. | |
| 5,937,070 | A * | 8/1999 | Todter et al. | 381/71.6 |
| 2001/0053228 | A1 | 12/2001 | Jones | |
| 2005/0213773 | A1 | 9/2005 | Donaldson et al. | |
| 2005/0249355 | A1 * | 11/2005 | Chen et al. | 381/71.14 |

OTHER PUBLICATIONS

Malaysian Office Action issued Sep. 14, 2012, in Patent Application No. PI 20084930.

* cited by examiner

*Primary Examiner* — Vivian Chin
*Assistant Examiner* — Con P Tran
(74) *Attorney, Agent, or Firm* — Oblon, McClelland, Maier & Neustadt, L.L.P.

(57) ABSTRACT

A noise cancelling headphone is described. The noise cancelling headphone utilizes a low power consuming noise cancellation circuit wherein an audio input signal is directly fed into the headphone without the use of an additional headphone amplifier. The noise cancelling circuit uses a microphone to pick up ambient noise and produces a signal which is equal in amplitude but opposite in polarity to the ambient noise signal. The resultant signal is mixed with the audio input signal and fed into the speakers of the headphone. This method is advantageous because it uses fewer components than conventional noise cancellation circuits and it also consumes less power due to the use of fewer components. The distortion of the audio input signal is also reduced since no amplification is performed to the audio input signal onboard the noise cancellation circuit.

20 Claims, 4 Drawing Sheets

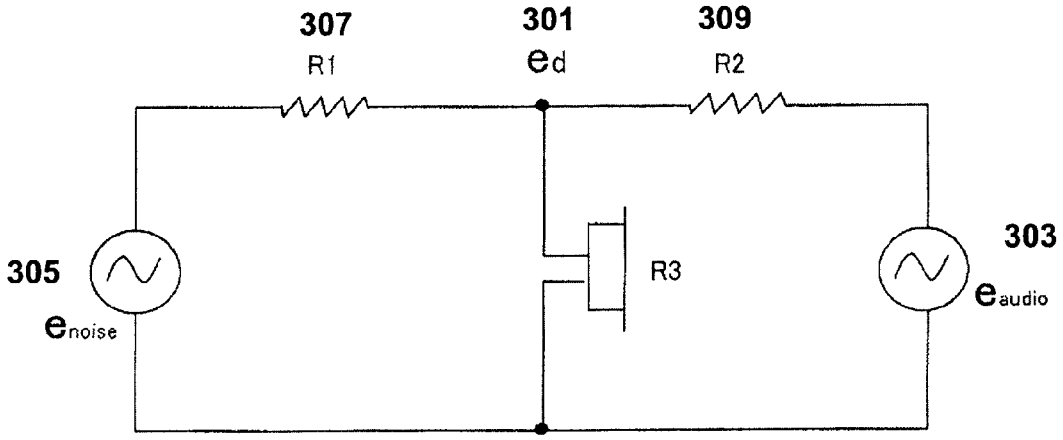

Driver supply voltage : $e_d$ $$e_d = \left(\frac{R2//R3}{R1 + R2//R3}\right) e_{noise} + \left(\frac{R1//R3}{R2 + R1//R3}\right) e_{audio}$$

$$= \frac{R2*R3}{\left(R1 + \frac{R2*R3}{R2 + R3}\right)\left(R2 + R3\right)} e_{noise} + \frac{R1*R3}{\left(R2 + \frac{R1*R3}{R1 + R3}\right)\left(R1 + R3\right)} e_{audio}$$

$$= \left(\frac{R2*R3}{R2*R3 + R1*R2 + R1*R3}\right) e_{noise} + \left(\frac{R1*R3}{R1*R3 + R1*R2 + R2*R3}\right) e_{audio}$$

$$= \frac{R2*R3*e_{noise} + R1*R3*e_{audio}}{\left(R1*R2 + R2*R3 + R1*R3\right)}$$

FIGURE 4

NOISE CANCELLING HEADPHONE

CROSS-REFERENCE TO RELATED APPLICATIONS

This application is based upon and claims the benefit of priority from the prior Malaysian Patent Application No. PI 20084930 filed on Dec. 4, 2008, the entire contents of which are incorporated herein by reference.

TECHNICAL FIELD

The invention relates to noise cancellation. More particularly this invention concerns a noise cancelling system using headphones.

RELATED ART

Noise cancellation methods are designed to reduce unwanted ambient sounds by using audio devices such as headphones. Ambient sound is known as the background sound pressure level present at any given location. In order to design a noise cancellation system, an audio source such as a headphone must emit a sound wave with the same amplitude but with the opposite polarity to the ambient sound present at the wearer's ears. The ambient sound wave and the sound wave from the headphone combine to form a new wave, where effectively the two waves cancel each other out in a process called phase cancellation at the wearer's ears. The resulting ambient sound wave may be at such low amplitude that it will be inaudible to human ears.

Modern noise cancellation headphone systems such as the system shown in the U.S. Pat. No. 5,825,897 use a signal processing circuit which takes in the ambient sound waveform through the use of a microphone and outputs a sound wave with opposite polarity as described above via a headphone. As can be seen in the diagrams the signal processing unit of the patent uses many circuit components such as amplifiers and notch filters to achieve a signal with opposite polarity. This would mean that the circuit would consume a high power level to power the many components and would also be costly to manufacture. This would be problematic in providing a cost effective noise cancellation system for personal use.

In the related art, a headphone amplification circuit has been used along with a pre-amplification circuit for the purpose of building a noise cancellation circuit. This was required because a sound wave needs to be produced with the same amplitude level as the ambient sound level in order to achieve successful cancellation of the two waves. The disadvantage of using such a circuit was that the presence of a headphone amplifier circuit in the noise cancellation circuit would consume a large amount of power and also the components would be costly when manufacturing.

Furthermore for conventional noise cancelling headphone devices used for listening to music or other audio sources, the output of the headphone is the combination of active audio signal carrying the music and the noise cancelling signal generated from the noise cancelling circuit. The two signals are combined together at the headphone amplifier circuit and this would increase the noise level present at the headphone output due to distortion present in analogue amplification. Therefore, a feature of the invention is to provide a noise cancelling headphone that ameliorates some of the above-described and other disadvantages and limitations of the known art.

SUMMARY OF THE INVENTION

A reduced power noise cancelling apparatus capable of outputting a noise cancelling audio signal to a speaker according to a first aspect the invention includes a receiver to receive an external noise signal, a pre-amplifier capable of pre-amplifying the external noise signal to a level capable of driving the speaker, a phase shifter capable of producing a phase shifted output signal from the pre-amplified external noise signal wherein the phase polarity of the phase shifted output signal is opposite to the phase polarity of the external noise signal at a listener's ear, and a summer to sum the phase shifted output signal and an audio input signal wherein the summation produces the noise cancelling audio signal.

In further embodiments, the reduced power noise cancelling apparatus further includes a matching device to match the impedance of the audio input signal to the speaker, the pre-amplifier could provide sufficient gain to drive the speaker without the aid of a speaker amplifier, the reduced power noise cancelling apparatus is a feed forward type reduced power noise cancelling apparatus, the reduced power noise cancelling apparatus is a feed back type reduced power noise cancelling apparatus, the receiver is a microphone capable of receiving an external noise signal, the amplitude of the noise cancelling audio signal is matched to an ambient noise level, the speaker is a headphone speaker, the audio input signal is supplied from an audio source, and/or the audio input signal is supplied from an audio source such as a CD player, mp3 player, personal computer or a similar device.

A further aspect is a method of reducing ambient noise present in an acoustic audio signal using a reduced power noise cancelling circuit wherein the method includes the steps of receiving an ambient noise signal through a microphone, phase shifting the received ambient noise signal such that the phase of a resultant phase shifted signal is opposite in polarity to the received ambient noise signal, pre-amplifying the resultant phase shifted signal so that the resultant phase shifted signal is capable of driving a speaker, summing the pre-amplified resultant phase shifted signal with an audio input signal and outputting the summed pre-amplified resultant phase shifted signal and the audio input signal to a speaker.

In further embodiments, the method includes the step of matching the impedance of the audio input signal to the impedance of the speaker, the method does not require an additional speaker amplifier to drive the speaker, the reduced power noise cancelling circuit is a feed forward type reduced power noise cancelling circuit, the reduced power noise cancelling apparatus is a feed back type reduced power noise cancelling circuit, the speaker is a headphone speaker, the audio input signal is supplied from an audio source, and/or the audio input signal is supplied from an audio source such as a CD player, mp3 player, personal computer or a similar device.

BRIEF DESCRIPTION OF THE DRAWINGS

Embodiments will now be described, by way of example only, by reference to the accompanying drawings:

FIG. 4 is a circuit diagram and an equation showing the relationship between the voltage components of the output audio signal supplied to the headphone.

DETAILED DESCRIPTION OF THE DRAWINGS

The following description will describe the invention in relation to preferred embodiments, namely a noise cancelling headphone. The invention is in no way limited to these preferred embodiments as they are purely to exemplify the invention only and that possible variations and modifications would be readily apparent without departing from the scope of the invention.

Figure 1:
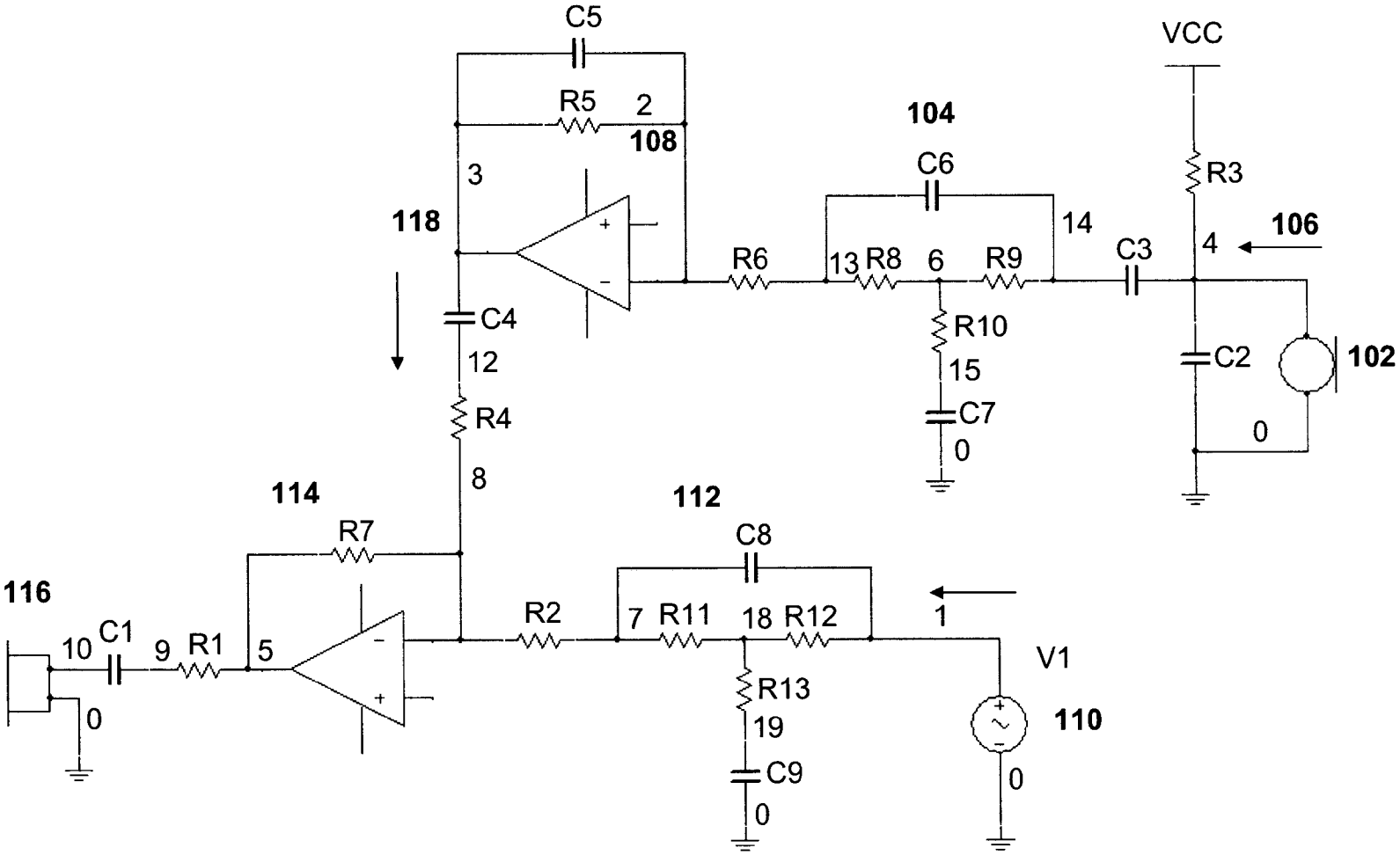
FIGURE 1 (PRIOR ART)
FIG. 1 is a circuit diagram of a conventional feed forward type noise cancelling circuit in accordance with the prior art.

FIG. 1 shows a typical noise cancellation circuit used in the prior art in which an audio signal is provided at 110 and an external ambient noise signal at 102 and combined to provide into speaker 116 a signal which will cancel ambient noise at the user's ear leaving only the audio signal. It could be seen that in the conventional noise cancellation circuit (FIG. 1) the audio input signal 110 must be fed into an audio equalizer circuit 112 before it is fed into a headphone amplifier 114. The audio equalizer circuit 112 is required to compensate for losses in frequency and phase in the audio input signal 110 and to equalize it. The audio response of the audio input signal 110 is adjustable by changing the component values of the equalizer circuit. Furthermore, it could be seen that in the conventional noise cancellation circuit, the ambient sound input 106 from the microphone 102 is fed in to a notch filter 104. The notch filter is a special band stop filter which attenuates frequencies within a narrow stop band. It is used to maintain an adequate gain and phase response required to form a phase shifted signal with the same amplitude as the input ambient sound signal 106 from the microphone 102. The output of the notch filter is fed into a preamplifier 108. Furthermore, in the conventional noise cancellation circuit (FIG. 1) the output 118 of the preamplifier 108 is mixed with the output from the audio equalizer 112 and fed into the headphone amplifier 114 prior to outputting to the headphone 116. As can be seen, a separate amplifier integrated circuit is required for the purpose of amplifying the output signal which would tend to add distortion to the audio input signal 110 as do all analogue audio amplifiers.

It can be clearly seen that the noise cancellation circuit (FIG. 2) of the present invention uses less components. The noise cancellation circuit shown is known as a feed forward type noise cancellation circuit where the noise cancellation signal 130 does not take input from the audio input signal 120. The audio input signal 120 may be any type of sound input source signal from a device such as a CD player, MP3 player or mobile device which sends an input to the headphone 116 via the noise cancellation circuit. In the noise cancellation circuit of the present invention, an audio equalizer is not used and hence the audio input signal 120 is directly fed into the headphone 116. The omission of an audio equalizer circuit reduces the number of components used in the circuit. However, an impedance matching circuit 134 including a resistor and capacitor is used in the circuit to correctly match the impedance of the input audio signal 120 to the headphone. As can be seen from FIGS. 1 and 2, the novel impedance matching circuit uses many less components than an audio equalizer circuit.

Figure 2:
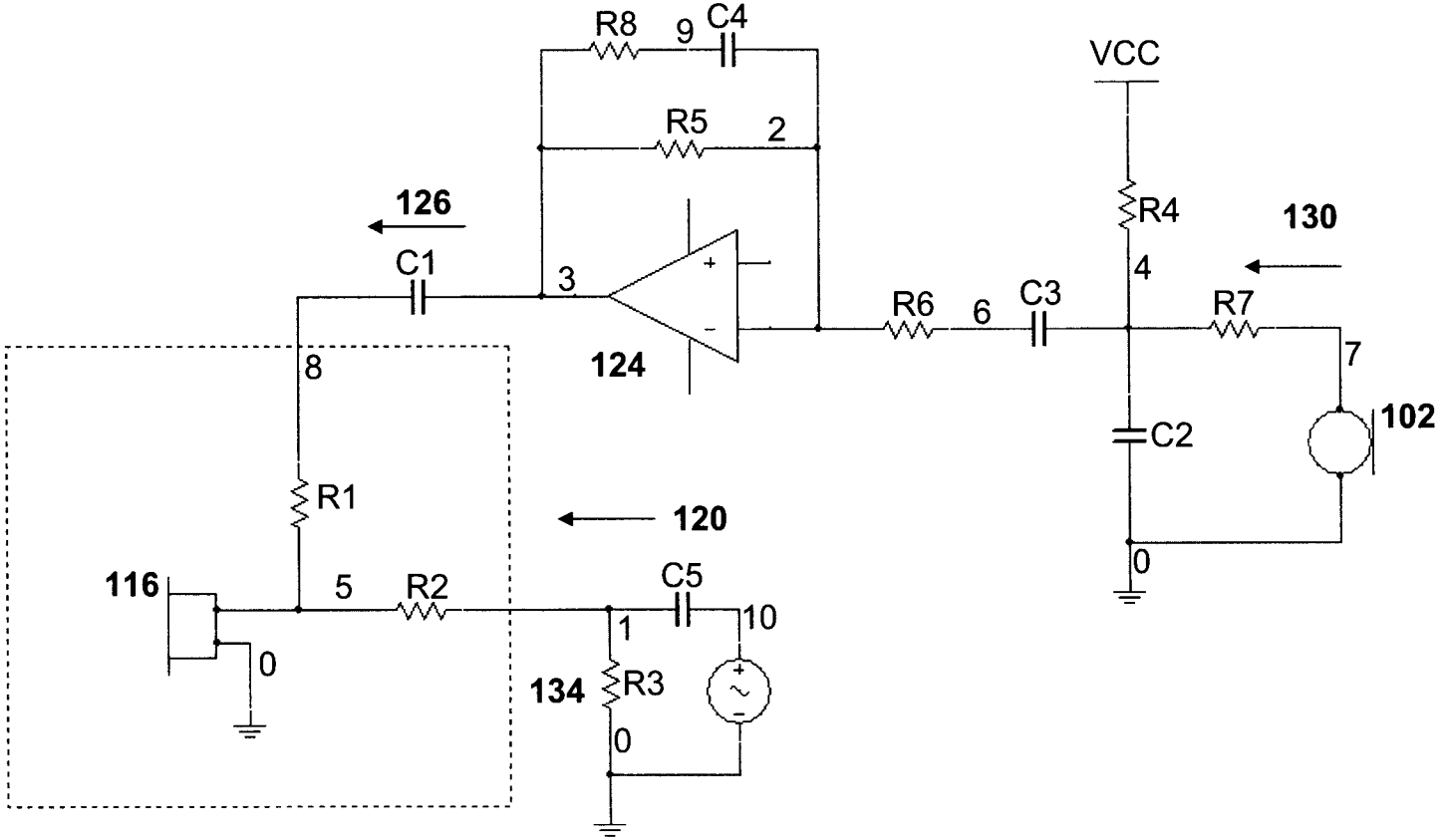
FIG. 2 is a circuit diagram of a new feed forward type noise cancelling circuit in accordance with a first preferred embodiment of the invention.

As previously explained, in order to reduce ambient sound at any given location a sound of equal amplitude but opposite polarity must be mixed with the ambient sound wave. In the present invention, a microphone, placed near or on the headphone, is used to capture the ambient sound present at the location where the headphone is used. FIG. 2 shows the microphone 102, where the input ambient sound signal 130 is fed directly into a preamplifier circuit 124. It can be seen that the noise cancellation circuit of the present invention has removed the need for a notch filter such as 104 of FIG. 1. This further reduces the need to use additional components in the circuit. As can be seen, preamplifier 124 and the associated components, adjusts the phase response of the preamplifier such that the resulting output from the preamplifier is a noise cancelling signal. The preamplifier is able to maintain the amplitude level of the ambient input sound wave at a level suitable to be output from the headphone 116 and to still have sufficient amplitude to cancel the ambient sound wave at headphone 116. Furthermore, in the present invention (FIG. 2) the output 126 from the preamplifier is mixed directly with the impedance matched audio input signal 120. The need for amplification is avoided since preamplifier output signal maintains a sufficient gain level to drive the headphone 116 directly.

Figure 3:
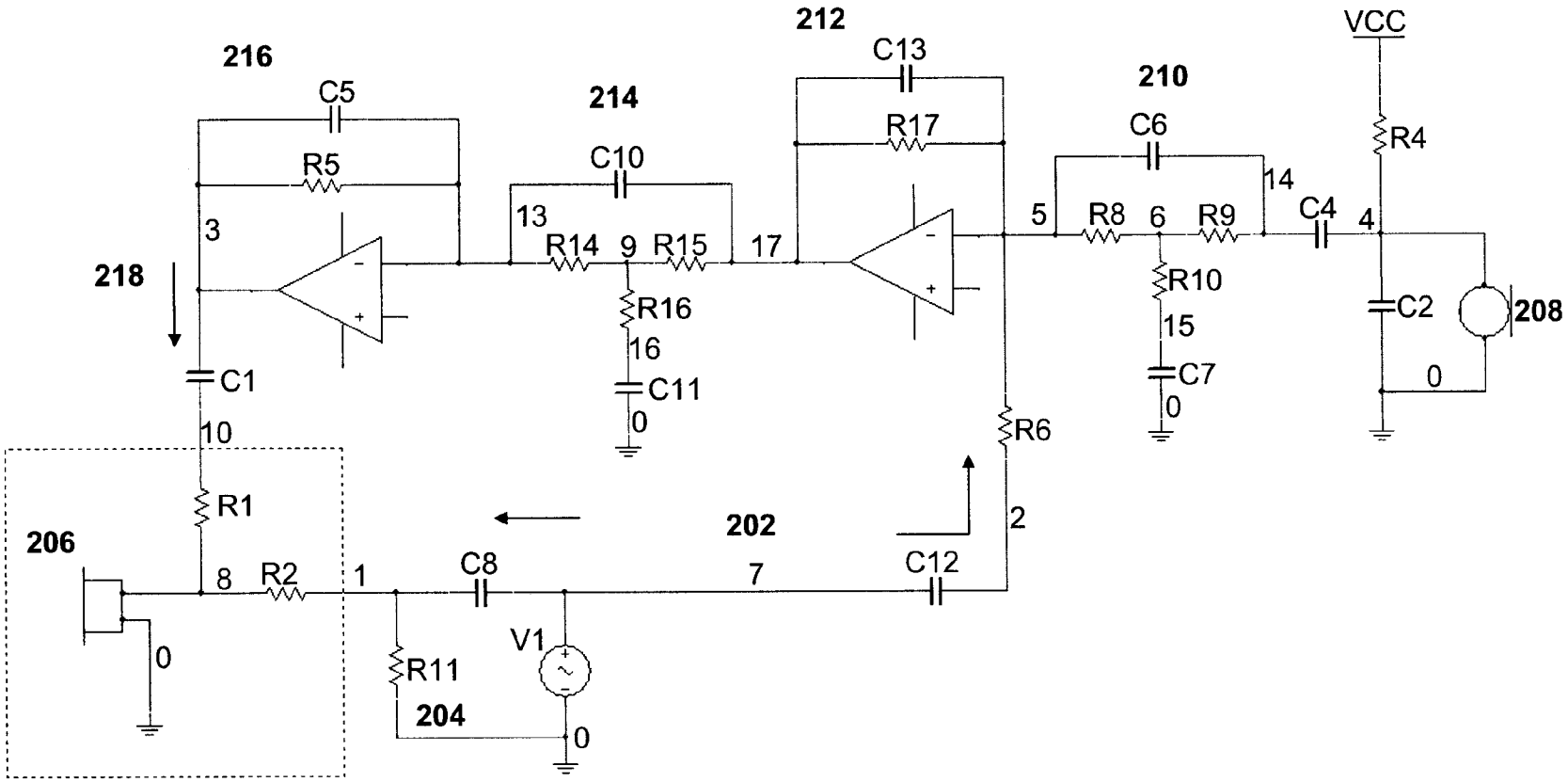
FIG. 3 is a circuit diagram of a new feed back type noise cancelling circuit in accordance with another preferred embodiment of the invention.

FIG. 3 shows a feedback type noise cancellation circuit in accordance with another preferred embodiment of the present invention. In a feedback type noise cancellation circuit, the audio signal input 202 is mixed with the noise cancellation signal prior to the notch filter 214 and the preamplifier 216. As shown in FIG. 3, the ambient sound wave is inputted via the microphone 208 and is fed into a notch filter 210. The notch filter is used provide the required gain and phase response to form the noise cancellation signal. The signal is then fed into a preamplifier 212 which takes feedback from the audio input signal 202. The output of the preamplifier 212 is fed into another notch filter 214 which again corrects the signal to provide the required gain and phase response. The output from the notch filter 214 is fed into a second preamplifier 216 which ensures that the gain of the output noise cancellation and audio signal is at a sufficient level. The combined noise cancellation and audio input signal 218 is directly mixed with the audio input signal 202. An impedance matching circuit 204 is used to match the impedance of the audio input signal 202 with the headphone 206 as described in the previous embodiment. It can be seen that the feedback type noise cancelling circuit of the present invention does not require an audio equalizer or a headphone amplifier. The circuit is able to provide a sufficient signal to drive the headphone directly from the preamplifier circuit.

FIG. 4 shows the components of the output signal of the noise cancellation circuit. As can be seen from the diagram and the equation, the output voltage signal $e_d$ 301 supplied to the headphone includes AC voltage components, namely an audio signal component $e_{audio}$ 303 and a noise cancellation signal component $e_{noise}$ 305. The equation is formed such that it provides $e_d$ 301 in terms of the total resistance R1 (307) at the source of the noise cancellation signal $e_{noise}$ 305 and the total resistance R2 (309) of the source of the input audio signal $e_{audio}$ 303 and the sink of the resistance R3 (311) of the headphone. It shows that the three resistances R1, R2, and R3 relate the two AC voltage components of the output signal with the output voltage signal $e_d$ 301. The purpose of the equation is to show that by manipulating the values of the resistances R1, R2, and R3 the level of the output voltage signal $e_d$ 301 could be varied as required by a user of the headphone 311 without the need to adjust the input voltage signals $e_{audio}$ 303 and $e_{noise}$ 305. Since the output voltage signal $e_d$ 301 is a summation of two signals, it has the characteristics of an audio signal component $e_{audio}$ 303 and noise cancelation signal $e_{noise}$ 305. The characteristics can be manipulated by varying R1, R2, and R3 values in order to obtain the required signal at the output.

The noise cancellation circuit described uses a minimum of components wherever possible as can be seen from the diagrams and the description above. The use of fewer components will reduce the cost of manufacturing of the circuit since expensive components such as amplifier ICs and filter circuits can be omitted. The minimum component usage will also result in reduction of size of the noise cancellation circuit and in-turn the size of the headphone combined with the circuit will itself also be reduced and more streamlined. Furthermore, the use of fewer components for the design of the noise cancellation circuit will also mean that the power consumption of the circuit will also be reduced. The lack of an onboard headphone amplifier will drastically reduce power usage and the headphones can be used for a longer period of time if powered by a battery.

As described in the description above, the noise cancellation circuit does not require the use of a headphone amplifier. A headphone amplifier uses active components such as operational amplifiers. The use of these components will increase the noise and distortion level of the input audio signal since analogue amplification will result in distortion inherently. By removing the headphone amplifier the noise cancellation circuit of the present invention has removed a major source of distortion from the output signal at the headphone.

As described previously, the noise cancelling circuit may be manufactured as a feed forward type noise cancelling circuit or a feed back type noise cancellation circuit. When used as a feedback type noise cancellation circuit the audio input signal is split into two paths where one audio input signal path is directly fed into the headphone and the other audio input signal path is used a feedback path and mixed with ambient sound signal. The circuit does need to use two notch filters in order ensure that the required gain and phase response is maintained at the output as described previously. However the headphone amplifier and the audio equalizer could be omitted in the feed back type noise cancellation circuit of the present invention.

Throughout the description of this specification, the word "comprise" and variations of that word such as "comprising" and "comprises", are not intended to exclude other additives, components, integers or steps.

It will of course be realised that while the foregoing has been given by way of illustrative example of this invention, all such and other modifications and variations thereto as would be apparent to persons skilled in the art are deemed to fall within the broad scope and ambit of this invention as is hereinbefore described.

The invention claimed is:

1. A reduced power noise cancelling apparatus for outputting a noise cancelling audio signal to a speaker comprising:

a receiver to receive an external noise signal;

a notch filter to receive the external noise signal from the receiver and to adjust the external noise signal to provide a required gain and phase response;

a first pre-amplification amplifier to receive the adjusted external noise signal from the notch filter and to pre-amplify the adjusted external noise signal;

a phase shifter to receive the pre-amplified external noise signal from the first pre-amplification amplifier and to produce a phase shifted output signal from the pre-amplified external noise signal, a phase polarity of the phase shifted output signal being opposite a phase polarity of the external noise signal at a hearer's ear;

a second pre-amplification amplifier to receive the shifted output signal from the phase shifter and to pre-amplify the shifted output signal to a level capable of driving the speaker; and a summation unit to sum the phase shifted output signal received from the second pre-amplification amplifier and an audio input signal to produce the noise cancelling audio signal, wherein the adjusted external noise signal from the notch filter is mixed with the audio input signal and the resultant mixed signal is received by and pre-amplified by the first pre-amplification amplifier.

2. The reduced power noise cancelling apparatus as claimed in claim 1, further comprising:

a matching unit to receive the audio input signal and to match impedance of the audio input signal to the speaker, wherein the summation unit sums the phase shifted output signal received from the second pre-amplification amplifier and the impedance matched audio input signal to produce the noise cancelling audio signal.

3. The reduced power noise cancelling apparatus as claimed in claim 2, wherein the second pre-amplification amplifier further sets a gain of the audio input signal to a predetermined level.

4. The reduced power noise cancelling apparatus as claimed in claim 1, wherein the second pre-amplification amplifier provides sufficient gain to drive the speaker without aid from a speaker amplifier.

5. The reduced power noise cancelling apparatus as claimed in claim 1, wherein the reduced power noise cancelling apparatus is a feed forward type reduced power noise cancelling apparatus.

6. The reduced power noise cancelling apparatus as claimed in claim 1, wherein the reduced power noise cancelling apparatus is a feed back type reduced power noise cancelling apparatus.

7. The reduced power noise cancelling apparatus as claimed in claim 1, wherein the receiver is a microphone.

8. The reduced power noise cancelling apparatus as claimed in claim 1, wherein an amplitude of the noise cancelling audio signal is matched to an ambient noise level.

9. The reduced power noise cancelling apparatus as claimed in claim 1, wherein the speaker is a headphone speaker.

10. The reduced power noise cancelling apparatus as claimed in claim 1, wherein the audio input signal is supplied from an audio source.

11. The reduced power noise cancelling apparatus as claimed in claim 10, wherein the audio input signal is supplied from an audio source including one of a CD player, mp3 player, or personal computer.

12. The reduced power noise cancelling apparatus as claimed in claim 1, wherein the second pre-amplification amplifier further sets a gain of the audio input signal to a predetermined level.

13. A method of reducing ambient noise present in an acoustic audio signal using a reduced power noise cancelling circuit, the method comprising:

receiving an ambient noise signal through a microphone;

adjusting, at a notch filter, the ambient noise signal to provide a required gain and phase response;

pre-amplifying, at a first pre-amplification amplifier, the adjusted ambient signal;

phase shifting, at a phase shifter, the amplified adjusted ambient noise signal such that a phase of a resultant phase shifted signal is opposite in polarity to the ambient noise signal;

pre-amplifying, at a second pre-amplification amplifier, the resultant phase shifted signal so that the resultant phase shifted signal is set to a level capable of driving a speaker;

summing, at a summation unit, the amplified resultant phase shifted signal with an audio input signal; and outputting the summed corrected resultant phase shifted signal and the audio input signal to a speaker, wherein the adjusted ambient noise signal from the notch filter is mixed with the audio input signal and the resultant mixed signal is received by and pre-amplified by the first pre-amplification amplifier.

14. The method as claimed in claim 13, wherein the method further comprises:

matching impedance of the audio input signal to the impedance of the speaker, wherein the summing sums the amplified resultant phase shifted signal and the impedance matched audio input signal.

15. The method as claimed in claim 13, wherein the pre-amplifying of the resultant phase shifted signal provides sufficient gain to drive the speaker without aid from a speaker amplifier.

16. The method as claimed in claim 13, wherein the reduced power noise cancelling circuit is a feed forward type reduced power noise cancelling circuit.

17. The method as claimed in claim 13, wherein the reduced power noise cancelling apparatus is a feed back type reduced power noise cancelling circuit.

18. The method as claimed in claim 13, the speaker is a headphone speaker.

19. The method as claimed in claim 13, the audio input signal is supplied from an audio source.

20. The method as claimed in claim 13, the audio input signal is supplied from an audio source including one of a CD player, mp3 player, or mobile device.

* * * * *